US011101574B2

(12) United States Patent
Tsai et al.

(10) Patent No.: US 11,101,574 B2
(45) Date of Patent: Aug. 24, 2021

(54) ANTENNA STRUCTURE

(71) Applicant: Quanta Computer Inc., Taoyuan (TW)

(72) Inventors: Chin-Lung Tsai, Taoyuan (TW); Ying-Cong Deng, Taoyuan (TW); Chung-Hung Lo, Taoyuan (TW); Kuan-Hsien Lee, Taoyuan (TW); Yi-Ling Tseng, Taoyuan (TW); Chung-Ting Hung, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 37 days.

(21) Appl. No.: 16/747,213

(22) Filed: Jan. 20, 2020

(65) Prior Publication Data

US 2021/0167521 A1 Jun. 3, 2021

(30) Foreign Application Priority Data

Nov. 28, 2019 (TW) ..... 108143306

(51) Int. Cl.
*H01Q 21/30* (2006.01)
*H01Q 1/24* (2006.01)
(Continued)

(52) U.S. Cl.
CPC ..... *H01Q 21/30* (2013.01); *H01Q 1/243* (2013.01); *H01Q 1/38* (2013.01); *H01Q 1/48* (2013.01)

(58) Field of Classification Search
CPC .. H01Q 1/243; H01Q 21/30; H01Q 1/38–1/48
See application file for complete search history.

(56) References Cited

U.S. PATENT DOCUMENTS 8,907,853 B2 * 12/2014 Ying ..... H01Q 1/243 343/702
2004/0108957 A1 * 6/2004 Umehara ..... H01Q 1/243 343/700 MS (Continued)

FOREIGN PATENT DOCUMENTS

TW 200905987 A 2/2009

OTHER PUBLICATIONS

Chinese language office action dated Jul. 22, 2020, issued in application No. TW 108143306.

*Primary Examiner* — Hasan Islam
(74) *Attorney, Agent, or Firm* — McClure, Qualey & Rodack, LLP

(57) ABSTRACT

An antenna structure includes a ground plane, a first radiation element, a second radiation element, a third radiation element, a fourth radiation element, and a dielectric substrate. The first radiation element has a feeding point. The second radiation element is coupled to the feeding point. The non-metal region is substantially surrounded by the first radiation element and the second radiation element. The third radiation element is coupled to a first shorting point on the ground plane. The third radiation element is adjacent to the first radiation element and the second radiation element. The fourth radiation element is coupled to a second shorting point on the ground plane. The fourth radiation element is adjacent to the second radiation element. The ground plane, the first radiation element, the second radiation element, the third radiation element, and the fourth radiation element are all disposed on the dielectric substrate.

9 Claims, 2 Drawing Sheets

(51) Int. Cl.
*H01Q 1/38* (2006.01)
*H01Q 1/48* (2006.01)

(56) References Cited

U.S. PATENT DOCUMENTS

2005/0153756 A1* 7/2005 Sato ..... H01Q 9/42
455/575.7
2018/0048076 A1* 2/2018 Wei ..... H01Q 9/045
2020/0411987 A1* 12/2020 Lo ..... H01Q 1/48

* cited by examiner

ANTENNA STRUCTURE

CROSS REFERENCE TO RELATED APPLICATIONS

This application claims priority of Taiwan Patent Application No. 108143306 filed on Nov. 28, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure that includes a ground plane, a first radiation element, a second radiation element, a third radiation element, a fourth radiation element, and a dielectric substrate. The first radiation element has a feeding point. The second radiation element is coupled to the feeding point. The non-metal region is substantially surrounded by the first radiation element and the second radiation element. The third radiation element is coupled to a first shorting point on the ground plane. The third radiation element is adjacent to the first radiation element and the second radiation element. The fourth radiation element is coupled to a second shorting point on the ground plane. The fourth radiation element is adjacent to the second radiation element. The ground plane, the first radiation element, the second radiation element, the third radiation element, and the fourth radiation element are all disposed on the dielectric substrate.

In some embodiments, the first radiation element is L-shaped and the fourth radiation element substantially is L-shaped.

In some embodiments, the second radiation element includes a first segment and a second segment which are coupled to each other. An obtuse angle is formed between the first segment and the second segment.

In some embodiments, the third radiation element includes a third segment and a fourth segment which are coupled to each other. An acute angle is formed between the third segment and the fourth segment. The sum of the acute angle and the obtuse angle is substantially equal to 180 degrees.

In some embodiments, the antenna structure covers a first frequency band, a second frequency band, and a third frequency band. The first frequency band is from 700 MHz to 960 MHz. The second frequency band is from 1710 MHz to 2200 MHz. The third frequency band is from 2400 MHz to 2700 MHz.

In some embodiments, a first coupling gap is formed between the third radiation element and the first radiation element, and a second coupling gap is formed between the third radiation element and the second radiation element, such that the third radiation element is excited by the first radiation element and the second radiation element using a coupling mechanism. A third coupling gap is formed between the fourth radiation element and the second radiation element, such that the fourth radiation element is excited by the second radiation element using a coupling mechanism.

In some embodiments, the length of the first radiation element is substantially equal to 0.25 wavelength of the low-frequency portion of the second frequency band. The low-frequency portion is from 1710 MHz to 1800 MHz.

In some embodiments, the length of the second radiation element is substantially equal to 0.25 wavelength of the high-frequency portion of the second frequency band. The high-frequency portion is from 1900 MHz to 2200 MHz.

In some embodiments, the length of the third radiation element is substantially equal to 0.25 wavelength of the first frequency band.

In some embodiments, the length of the fourth radiation element is substantially equal to 0.25 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
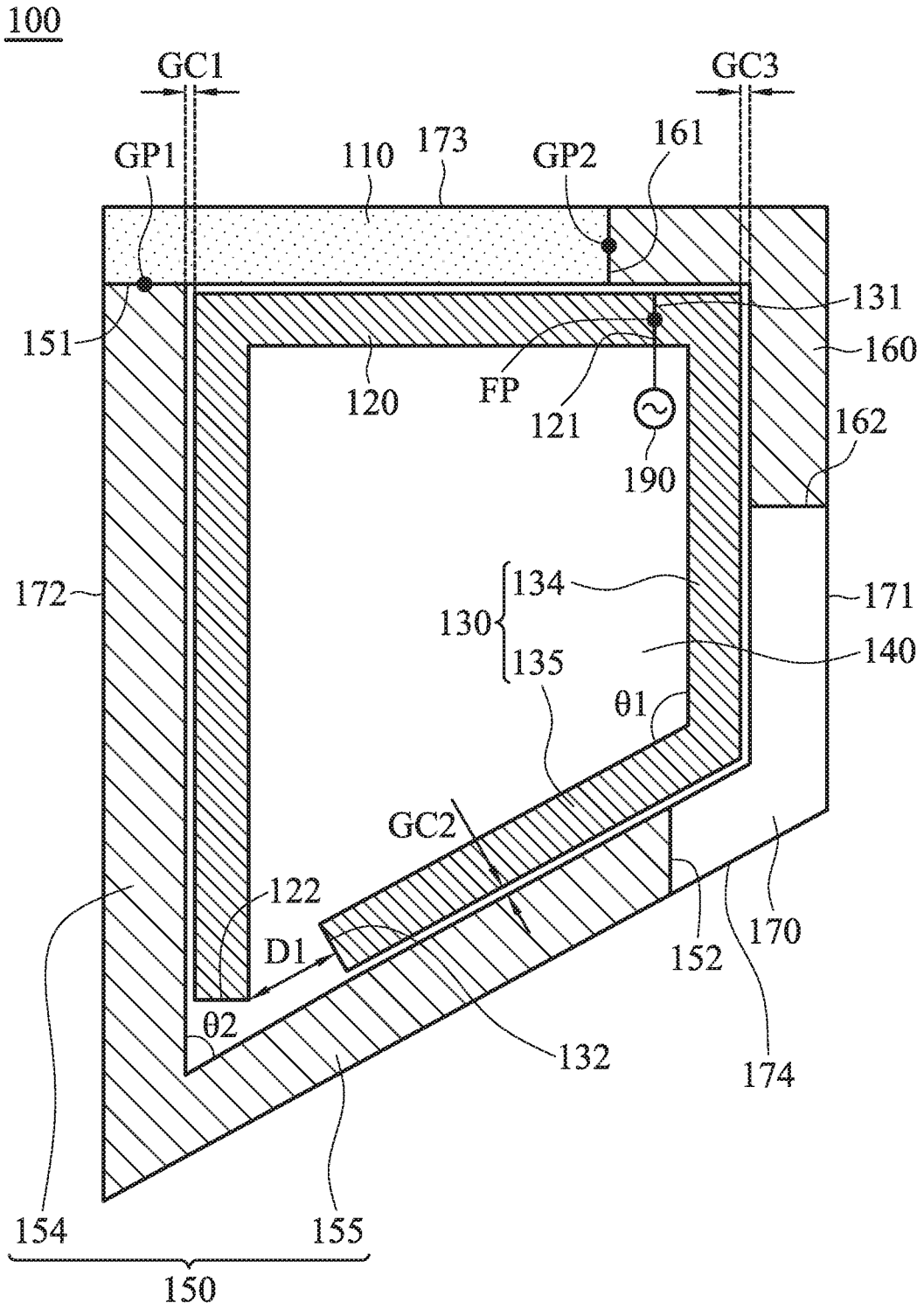
FIG. 1 is a top view of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of an antenna structure 100 according to an embodiment of the invention. The antenna structure 100 may be applied to a mobile device, such as a VR (Virtual Reality) device, an AR (Augmented Reality) device, a smart phone, a tablet computer, or a notebook computer. As shown in FIG. 1, the antenna structure 100 at least includes a ground plane 110, a first radiation element 120, a second radiation element 130, a third radiation element 150, a fourth radiation element 160, and a dielectric substrate 170. The ground plane 110, the first radiation element 120, the second radiation element 130, the third radiation element 150, and the fourth radiation element 160 may all be made of metal materials, such as silver, copper, aluminum, iron, or their alloys.

The dielectric substrate 170 may be an FR4 (Flame Retardant 4) substrate, a PCB (Printed Circuit Board), or an FCB (Flexible Circuit Board). The ground plane 110, the first radiation element 120, the second radiation element 130, the third radiation element 150, and the fourth radiation element 160 are all disposed on the dielectric substrate 170, and therefore the antenna structure 100 may be substantially planar. The dielectric substrate 170 may substantially have a trapezoidal shape. Specifically, the dielectric substrate 170 has a first edge 171, a second edge 172, a third edge 173, and a fourth edge 174. The first edge 171 and the second edge 172 are parallel to each other. The third edge 173 and the fourth edge 174 are not parallel to each other.

The ground plane 110 may substantially have a rectangular shape. For example, the ground plane 110 may be a ground copper foil, which may be further coupled to a system ground plane (not shown). The ground plane 110 may be adjacent to the third edge 173 of the dielectric substrate 170, and it is used to provide a ground voltage. It should be noted that the term "adjacent" or "close" over the disclosure means that the distance (spacing) between two corresponding elements is smaller than a predetermined distance (e.g., 15 mm or shorter), or means that the two corresponding elements are touching each other directly (i.e., the aforementioned distance/spacing therebetween is reduced to 0).

The first radiation element 120 may substantially have a relatively long L-shape. Specifically, the first radiation element 120 has a first end 121 and a second end 122. A feeding point FP is positioned at the first end 121 of the first radiation element 120. The second end 122 of the first radiation element 120 is an open end. The feeding point FP may be further coupled to a signal source 190, such as an RF (Radio Frequency) module, for exciting the antenna structure 100.

The second radiation element 130 may include at least one bending portion. The non-metal region 140 is surrounded by the first radiation element 120 and the second radiation element 130. For example, the non-metal region 140 may substantially have a rectangular shape or a trapezoidal shape, but it is not limited thereto. Specifically, the second radiation element 130 has a first end 131 and a second end 132. The first end 131 of the second radiation element 130 is coupled to the feeding point FP. The second end 132 of the second radiation element 130 is an open end. The second end 132 of the second radiation element 130 is adjacent to the second end 122 of the first radiation element 120, but is completely separate from the second end 122 of the first radiation element 120. In some embodiments, the second radiation element 130 includes a first segment 134 and a second segment 135 which are coupled to each other. The first segment 134 is adjacent to the first end 131 of the second radiation element 130. The second segment 135 is adjacent to the second end 132 of the second radiation element 130. The first segment 134 substantially has a straight-line shape and the second segment 135 substantially has a straight-line shape. There is an obtuse angle θ1 formed between the first segment 134 and the second segment 135. The obtuse angle θ1 may be from 90 to 180 degrees.

The third radiation element 150 may include at least one bending portion. The third radiation element 150 may extend along the second edge 172 and the fourth edge 174 of the dielectric substrate 170. The third radiation element 150 is adjacent to both the first radiation element 120 and the second radiation element 130. Specifically, the third radiation element 150 has a first end 151 and a second end 152. The first end 151 of the third radiation element 150 is coupled to a first shorting point GP1 on the ground plane 110. The second end 152 of the third radiation element 150 is an open end. In some embodiments, the third radiation element 150 includes a third segment 154 and a fourth segment 155 which are coupled to each other. The third segment 154 is adjacent to the first end 151 of the third radiation element 150. The fourth segment 155 is adjacent to the second end 152 of the third radiation element 150. The third segment 154 substantially has a straight-line shape and the fourth segment 155 substantially has a straight-line shape. There is an acute angle θ2 formed between the third segment 154 and the fourth segment 155. The acute angle θ2 may be from 0 to 90 degrees. In some embodiments, the sum of the acute angle θ2 and the obtuse angle θ1 is substantially equal to 180 degrees (i.e., θ1+θ2=180 degrees).

The fourth radiation element 160 may substantially have a relatively short L-shape. The fourth radiation element 160 may extend along the third edge 173 and the first edge 171 of the dielectric substrate 170. The fourth radiation element 160 is adjacent to the second radiation element 130. The third radiation element 150 and the fourth radiation element 160 can at least partially surround the first radiation element 120 and the second radiation element 130. Specifically, the fourth radiation element 160 has a first end 161 and a second end 162. The first end 161 of the fourth radiation element 160 is coupled to a second shorting point GP2 on the ground plane 110. The second end 162 of the fourth radiation element 160 is an open end. It should be noted that the second shorting point GP2 is different from the aforementioned first shorting point GP1. The first shorting point GP and the second shorting point GP2 may be positioned at two opposite ends of the ground plane 110, respectively.

Figure 2:
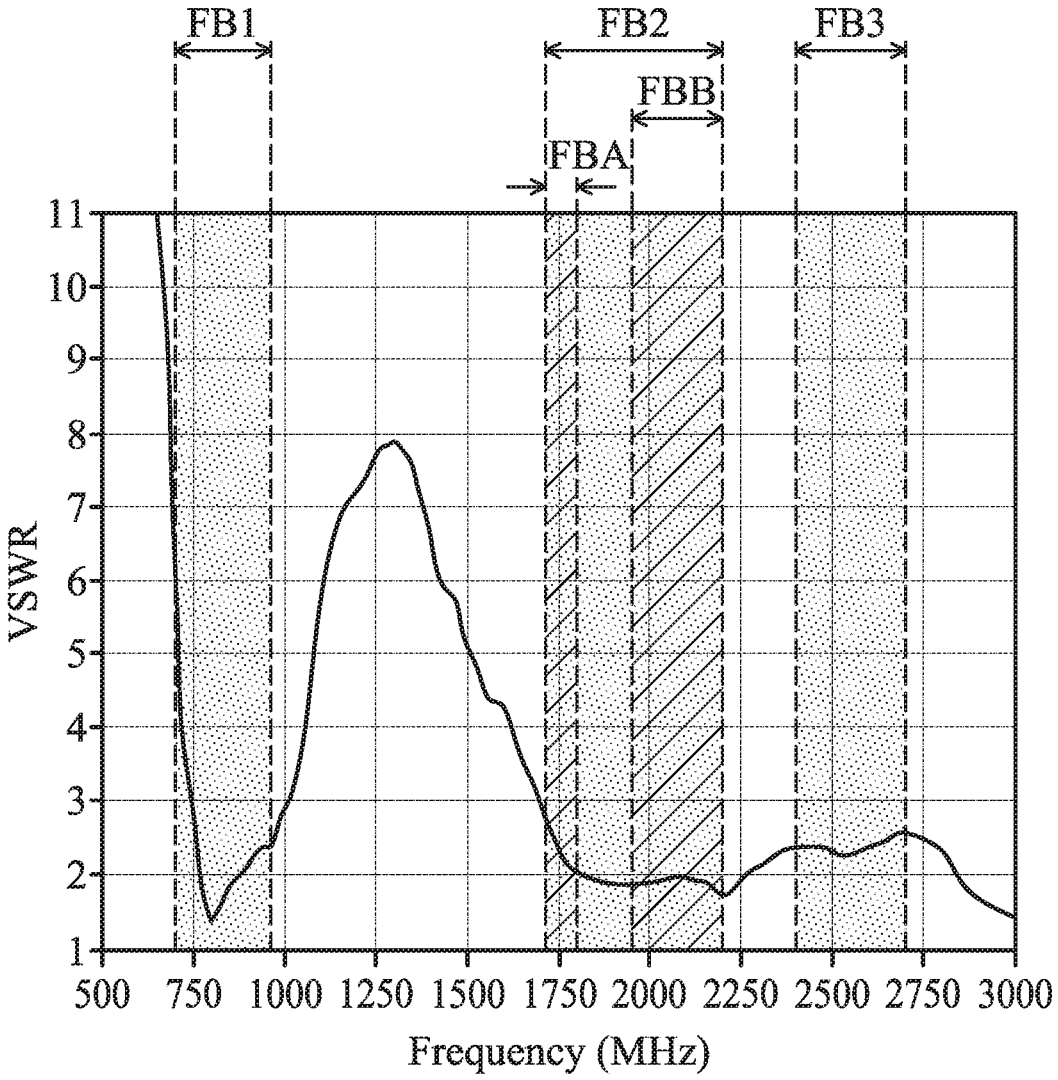
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 2, the antenna structure 100 can cover a first frequency band FB1, a second frequency band FB2, and a third frequency band FB3. For example, the first frequency band FB1 may be from 700 MHz to 960 MHz, the second frequency band FB2 may be from 1710 MHz to 2200 MHz, and the third frequency band FB3 may be from 2400 MHz to 2700 MHz. Specifically, the second frequency band FB2 includes a low-frequency portion FBA from 1710 MHz to 1800 MHz, and a high-frequency portion FBB from 1900 MHz to 2200 MHz. Accordingly, the antenna structure 100 can support at least the wideband operation of LTE (Long Term Evolution).

In some embodiments, the operation principles of the antenna structure 100 are described as follows. A first coupling gap GC1 is formed between the third radiation element 150 and the first radiation element 120, and a second coupling gap GC2 is formed between the third radiation element 150 and the second radiation element 130, therefore the third radiation element 150 is excited by the first radiation element 120 and the second radiation element 130 using a coupling mechanism, so as to generate the first frequency band FB1 and the second frequency band FB2. In addition, a third coupling gap GC3 is formed between the fourth radiation element 160 and the second radiation element 130, and therefore the fourth radiation element 160 is excited by the second radiation element 130 using a coupling mechanism, so as to generate the third frequency band FB3. Generally, the third radiation element 150 is configured to fine-tune the impedance matching of the first frequency band FB1 and the second frequency band FB2, and to increase the operation bandwidth of the first frequency band FB1 and the second frequency band FB2. The fourth radiation element 160 is configured to fine-tune the impedance matching of the third frequency band FB3, and to increase the operation bandwidth of the third frequency band FB3.

In some embodiments, the element sizes of the antenna structure 100 are described as follows. The length of the first radiation element 120 (i.e., the length from the first end 121 to the second end 122) may be substantially equal to 0.25 wavelength (λ/4) of the low-frequency portion FBA of the second frequency band FB2. The length of the second radiation element 130 (i.e., the length from the first end 131 to the second end 132) may be substantially equal to 0.25 wavelength (λ/4) of the high-frequency portion FBB of the second frequency band FB2. The length of the third radiation element 150 (i.e., the length from the first end 151 to the second end 152) may be substantially equal to 0.25 wavelength (λ/4) of the first frequency band FB1. The length of the fourth radiation element 160 (i.e., the length from the first end 161 to the second end 162) may be substantially equal to 0.25 wavelength (λ/4) of the third frequency band FB3. The width of the first coupling gap GC1 may be from 0.1 mm to 0.3 mm. The width of the second coupling gap GC2 may be from 0.1 mm to 0.3 mm. The width of the third coupling gap GC3 may be from 0.1 mm to 0.3 mm. The distance D1 between the second end 122 of the first radiation element 120 and the second end 132 of the second radiation element 130 may be from 5 mm to 15 mm. The obtuse angle θ1 may be from 120 to 135 degrees. The acute angle θ2 may be from 45 to 60 degrees. The above ranges of element sizes are calculated and obtained according to many experiment results, and they help to optimize the operation bandwidth and impedance matching of the antenna structure 100.

The invention proposes a novel antenna structure, which can effectively use fragment space in the relative device and cover multiband operations. In comparison to conventional designs, the invention has at least the advantages of small size, wide bandwidth, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-2. The invention may merely include any one or more features of any one or more embodiments of FIGS. 1-2. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground plane;

a first radiation element, having a feeding point;

a second radiation element, coupled to the feeding point, wherein a non-metal region is surrounded by the first radiation element and the second radiation element;

a third radiation element, coupled to a first shorting point on the ground plane, wherein the third radiation element is adjacent to the first radiation element and the second radiation element;

a fourth radiation element, coupled to a second shorting point on the ground plane, wherein the fourth radiation element is adjacent to the second radiation element; and a dielectric substrate, wherein the ground plane, the first radiation element, the second radiation element, the third radiation element, and the fourth radiation element are disposed on the dielectric substrates;

wherein the second radiation element comprises a first segment and a second segment coupled to each other, and an obtuse angle is formed between the first segment and the second segment.

2. The antenna structure as claimed in claim 1, wherein each of the first radiation element and the fourth radiation element substantially has an L-shape.

3. The antenna structure as claimed in claim 1, wherein the third radiation element comprises a third segment and a fourth segment coupled to each other, an acute angle is formed between the third segment and the fourth segment, and a sum of the acute angle and the obtuse angle is substantially equal to 180 degrees.

4. The antenna structure as claimed in claim 1, wherein the antenna structure covers a first frequency band, a second frequency band, and a third frequency band, the first frequency band is from 700 MHz to 960 MHz, the second frequency band is from 1710 MHz to 2200 MHz, and the third frequency band is from 2400 MHz to 2700 MHz.

5. The antenna structure as claimed in claim 4, wherein a first coupling gap is formed between the third radiation element and the first radiation element, and a second coupling gap is formed between the third radiation element and the second radiation element, such that the third radiation element is excited by the first radiation element and the second radiation element using a coupling mechanism, and wherein a third coupling gap is formed between the fourth radiation element and the second radiation element, such that the fourth radiation element is excited by the second radiation element using a coupling mechanism.

6. The antenna structure as claimed in claim 4, wherein a length of the first radiation element is substantially equal to 0.25 wavelength of a low-frequency portion of the second frequency band, and the low-frequency portion is from 1710 MHz to 1800 MHz.

7. The antenna structure as claimed in claim 4, wherein a length of the second radiation element is substantially equal to 0.25 wavelength of a high-frequency portion of the second frequency band, and the high-frequency portion is from 1900 MHz to 2200 MHz.

8. The antenna structure as claimed in claim 4, wherein a length of the third radiation element is substantially equal to 0.25 wavelength of the first frequency band.

9. The antenna structure as claimed in claim 4, wherein a length of the fourth radiation element is substantially equal to 0.25 wavelength of the third frequency band.

* * * * *